US009064626B2

(12) United States Patent
Yoo et al.

(10) Patent No.: US 9,064,626 B2
(45) Date of Patent: Jun. 23, 2015

(54) THIN FILM-TYPE COIL COMPONENT AND METHOD OF FABRICATING THE SAME

(75) Inventors: Young Seuck Yoo, Seoul (KR); Young Ghyu Ahn, Gyunggi-do (KR); Yong Suk Kim, Gyunggi-do (KR); Sung Kwon Wi, Seoul (KR); Sang Soo Park, Gyunggi-do (KR); Kang Heon Hur, Gyunggi-do (KR)

(73) Assignee: SAMSUNG ELECTRO-MECHANICS CO., LTD., Suwon, Gyunggi-Do (KR)

( * ) Notice: Subject to any disclaimer, the term of this patent is extended or adjusted under 35 U.S.C. 154(b) by 0 days.

(21) Appl. No.: 13/417,832

(22) Filed: Mar. 12, 2012

(65) Prior Publication Data

US 2013/0169399 A1 Jul. 4, 2013

(30) Foreign Application Priority Data

Dec. 29, 2011 (KR) ..... 10-2011-0146088

(51) Int. Cl.

| | |
|---|---|
| ***H01F 27/28*** | (2006.01) |
| ***H01F 27/29*** | (2006.01) |
| ***H01F 5/00*** | (2006.01) |
| ***H01F 17/00*** | (2006.01) |
| ***H01F 41/04*** | (2006.01) |

(52) U.S. Cl.

CPC ..... *H01F 17/0013* (2013.01); *H01F 41/042* (2013.01)

(58) Field of Classification Search

CPC ..... H01F 27/38; H01F 27/306; H01F 37/00; H01F 17/0013; H01L 2924/00013

USPC ..... 336/180, 182, 192, 200, 222, 232, 234

See application file for complete search history.

(56) References Cited

U.S. PATENT DOCUMENTS

| | | | | |
|---|---|---|---|---|
| 5,111,169 | A * | 5/1992 | Ikeda | 333/181 |
| 5,602,517 | A * | 2/1997 | Kaneko et al. | 333/185 |
| 6,727,782 | B2 * | 4/2004 | Sasaki et al. | 333/185 |
| 7,446,632 | B2 * | 11/2008 | Tomonari et al. | 333/185 |

(Continued)

FOREIGN PATENT DOCUMENTS

| | | | |
|---|---|---|---|
| JP | 08-186024 | A | 7/1996 |
| JP | 10-163028 | A | 6/1998 |
| JP | 2000-299221 | A | 10/2000 |
| JP | 2003-031416 | A | 1/2003 |

(Continued)

OTHER PUBLICATIONS

Japanese Office Action, w/ English translation thereof, issued in Japanese Patent Application No. JP 2012-059850 dated Dec. 3, 2013.

(Continued)

*Primary Examiner* — Alexander Talpalatski
*Assistant Examiner* — Kazi Hossain
(74) *Attorney, Agent, or Firm* — McDermott Will & Emery LLP

(57) ABSTRACT

There is provided a thin film-type coil component having a size equal to or less than 0806 and including a ceramic main body, external electrodes including a plurality of first external electrodes formed on one surface of the ceramic main body and a plurality of second external electrodes formed on the other surface facing one surface of the ceramic main body, and a coil unit including a plurality of coil layers stacked in the ceramic main body, thereby obtaining low direct current (DC) resistance.

16 Claims, 6 Drawing Sheets

(56) References Cited

U.S. PATENT DOCUMENTS

| | | | | |
|---|---|---|---|---|
| 7,474,191 | B2 * | 1/2009 | Ito et al. | 336/200 |
| 7,663,225 | B2 * | 2/2010 | Kudo et al. | 257/700 |
| 7,911,295 | B2 * | 3/2011 | Inuzuka et al. | 333/185 |
| 8,089,331 | B2 * | 1/2012 | Jacobson et al. | 336/84 C |
| 2004/0130415 | A1 * | 7/2004 | Chiba et al. | 333/185 |
| 2004/0263309 | A1 * | 12/2004 | Ito et al. | 336/200 |
| 2009/0295526 | A1 * | 12/2009 | Mikami et al. | 336/196 |
| 2010/0052135 | A1 * | 3/2010 | Shim et al. | 257/686 |
| 2011/0133881 | A1 * | 6/2011 | Nakajima et al. | 336/200 |

FOREIGN PATENT DOCUMENTS

| | | |
|---|---|---|
| JP | 2006-319009 | 11/2006 |
| JP | 2007-324555 A | 12/2007 |
| JP | 2008-025381 | 2/2008 |
| JP | 2008-205216 A | 9/2008 |
| JP | 2010-177380 | 8/2010 |

OTHER PUBLICATIONS

Korean Office Action dated Aug. 1, 2014 issued in Korean Patent Application No. 10-2011-0146088 (English translation).

* cited by examiner

X-X'

THIN FILM-TYPE COIL COMPONENT AND METHOD OF FABRICATING THE SAME

CROSS-REFERENCE TO RELATED APPLICATIONS

This application claims the priority of Korean Patent Application No. 10-2011-0146088 filed on Dec. 29, 2011, in the Korean Intellectual Property Office, the disclosure of which is incorporated herein by reference.

BACKGROUND OF THE INVENTION

1. Field of the Invention

The present invention relates to a thin film-type coil component and a method of fabricating the same, and more particularly, to a thin film-type coil component having low direct current (DC) resistance and a method of fabricating the thin film-type coil component.

2. Description of the Related Art

Data transmission and reception functions via a high-frequency band in electronic products such as digital televisions (TVs), smart phones, and notebook computers have been widely implemented. In the future, such an information technology (IT) electronic products are also expected to be frequently provided with multi-functionality and complex characteristics not only when used alone, but also when connected to another device via a universal serial bus (USB) or another communication port.

However, in order to rapidly transmit and receive data, data should be transmitted through as many internal signal lines as possible by changing frequencies used for a frequency terminal from a band within the MHz band according to the related art to a high-frequency band within the GHz band.

In order to transmit a large amount of data, data should be transmitted between main devices and peripheral devices in a high-frequency band within the GHz band. In this case, defects may arise in terms of smoothly processing the data, due to signal delay and other interference. In particular, as in the case of digital TV, when communication signal lines, video signal lines, audio signal lines, and so on are connected by using various port-to-port methods, defects may frequently arise in terms of internal signal line delay and transmission distortion.

In order to address these defects, electromagnetic interference (EMI) shielding components are arranged in the vicinity of connection areas between IT devices and peripheral devices. Since wound-rotor type and stack type EMI shielding components according to the related art include large-sized chip components having poor electrical properties, EMI shielding components can only be used in a particular region or in a limited region of a large-area circuit board.

Recently, along with the development of slim, small-sized, complex, and multifunctional electronic products, there is a need for EMI shielding components for satisfying these functions.

Since there is a limit to forming internal circuits required when forming internal conductive patterns and to perform additional various functions by using a small area so as to correspond to a small-sized electronic device, it may be difficult to use wound-rotor type and stack type EMI shielding components according to the related art in electronic devices.

SUMMARY OF THE INVENTION

An aspect of the present invention provides a thin film-type coil component having low direct current (DC) resistance and a method of fabricating the same.

According to an aspect of the present invention, there is provided a thin film-type coil component, including a main body; and external electrodes including a plurality of first external electrodes formed on one surface of the main body and a plurality of second external electrodes formed on the other surface facing one surface of the main body, wherein the main body includes an upper substrate and a lower substrate; an insulating layer formed between the upper substrate and the lower substrate; and a coil layer disposed in the insulating layer and including first and second coils as a double coil, wherein the first and second coils are wound to be parallel to each other in the same direction on the same plane, and wherein one ends of the first and second coils are connected to the external electrodes, and the other ends of the first and second coils are respectively connected to first and second centers, wherein the main body includes a plurality of the coil layers, and the first and second coils are connected to each other in parallel.

The thin film-type coil component may have a size equal to or less than 0806.

The first and second centers of neighboring coil layers among the plurality of coil layers may be connected through via conductors, respectively.

The neighboring coil layers among the plurality of coil layers may be connected to first and second external electrodes, respectively.

Coils of the neighboring coil layers among the plurality of coil layers may be wound in opposite directions.

The first and second centers may be spaced apart from each other.

The double coil may have a polygonal shape, a circular shape, an oval shape, or an irregular shape.

The double coil may include at least one selected from the group consisting of gold (Au), silver (Ag), platinum (Pt), copper (Cu), nickel (Ni), palladium (Pd), and an alloy thereof.

The first coil and the second coil may be connected to the external electrodes through outlet terminals, respectively.

Portions of the outlet terminals exposed from a surface of the main body may be covered by the external electrodes.

The outlet terminals may include at least one selected from the group consisting of Au, Ag, Pt, Cu, Ni, Pd, and an alloy thereof.

The double coil and the outlet terminals may include the same material.

The upper substrate and the lower substrate may be formed of a magnetic material.

The magnetic material may include nickel-zinc-copper (Ni—Zn—Cu) ferrite.

The insulating layer may include a photosensitive polymer insulating material.

The plurality of first and second external electrodes may be arranged to face each other.

The external electrodes may extend in a thickness direction of the main body.

The external electrodes may extend onto portions of an upper surface and a lower surface of the main body.

The external electrodes may include at least one selected from the group consisting of Au, Ag, Pt, Cu, Ni, Pd, and an alloy thereof.

According to another aspect of the present invention, there is provided a method of fabricating a thin film-type coil component, including a first operation of forming a first double coil having first and second centers on a lower substrate; a second operation of forming an insulating layer on the lower substrate on which the first double coil is formed; a third operation of forming via conductors in portions of the insulating layer corresponding to the first and second centers of the first double coil; a fourth operation of forming a second double coil on the insulating layer so as to have centers that are respectively formed to correspond to the via conductors; a fifth operation of forming a stack structure including a required number of layers formed by repeating the second through fourth operations; and a sixth operation of forming an upper substrate on the stack structure.

The first and second double coils may be wound in opposite directions.

The first and second centers may be spaced apart from each other.

Each of the first and second double coils may have a polygonal shape, a circular shape, an oval shape, or an irregular shape.

Each of the first and second double coils may include at least one selected from the group consisting of Au, Ag, Pt, Cu, Ni, Pd, and an alloy thereof.

The upper substrate and the lower substrate may be formed of a magnetic material.

The magnetic material may include Ni—Zn—Cu ferrite.

The insulating layer may include a photosensitive polymer insulating material.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
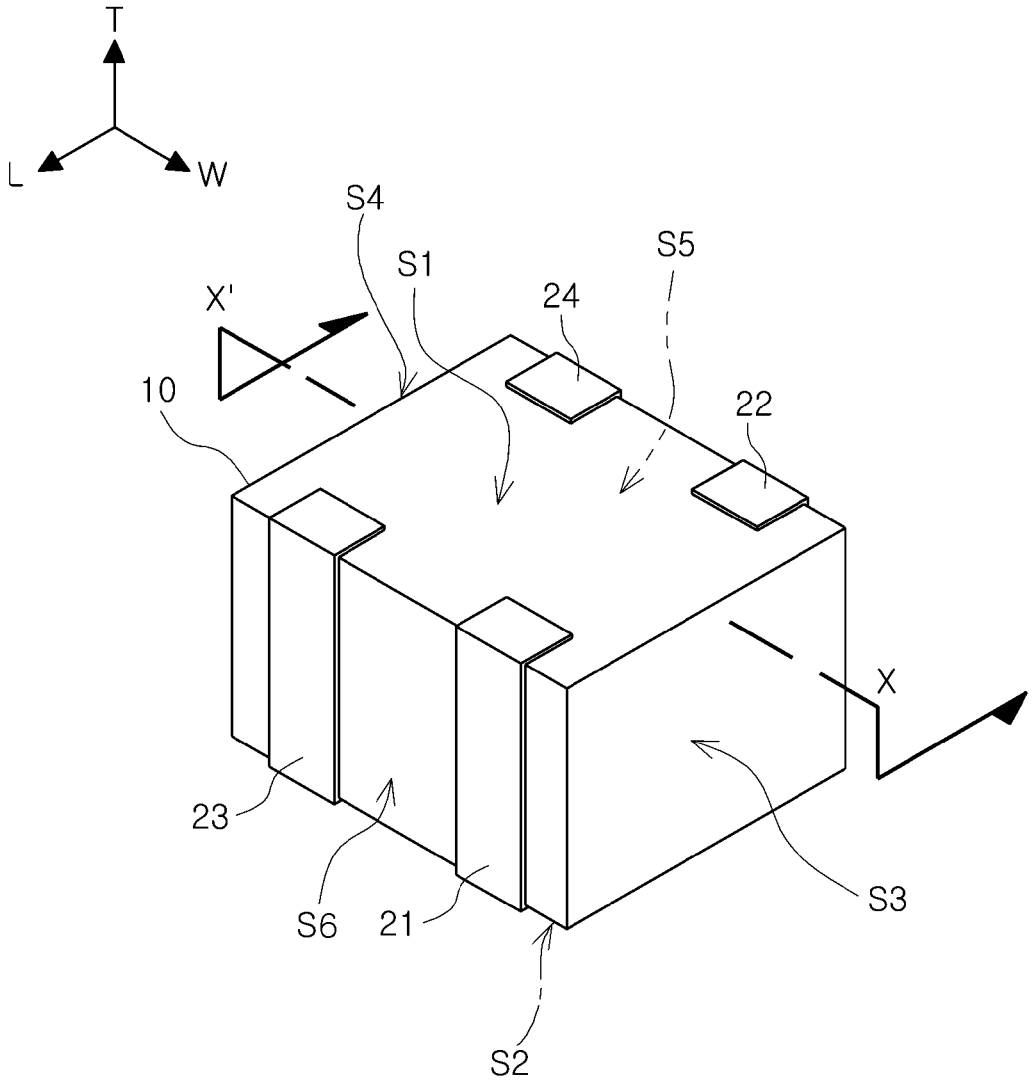
FIG. 1 is a perspective view of a thin film-type coil component according to an embodiment of the present invention.

Embodiments of the present invention will now be described in detail with reference to the accompanying drawings. However, the embodiments of the present invention may be modified in many different forms and the scope of the invention should not be limited to the embodiments set forth herein.

In addition, these embodiments are provided so that this disclosure will be thorough and complete, and will fully convey the concept of the invention to those skilled in the art. Therefore, in the drawings, the shapes and dimensions may be exaggerated for clarity, and the same reference numerals will be used throughout to designate the same or like components.

Figure 2:
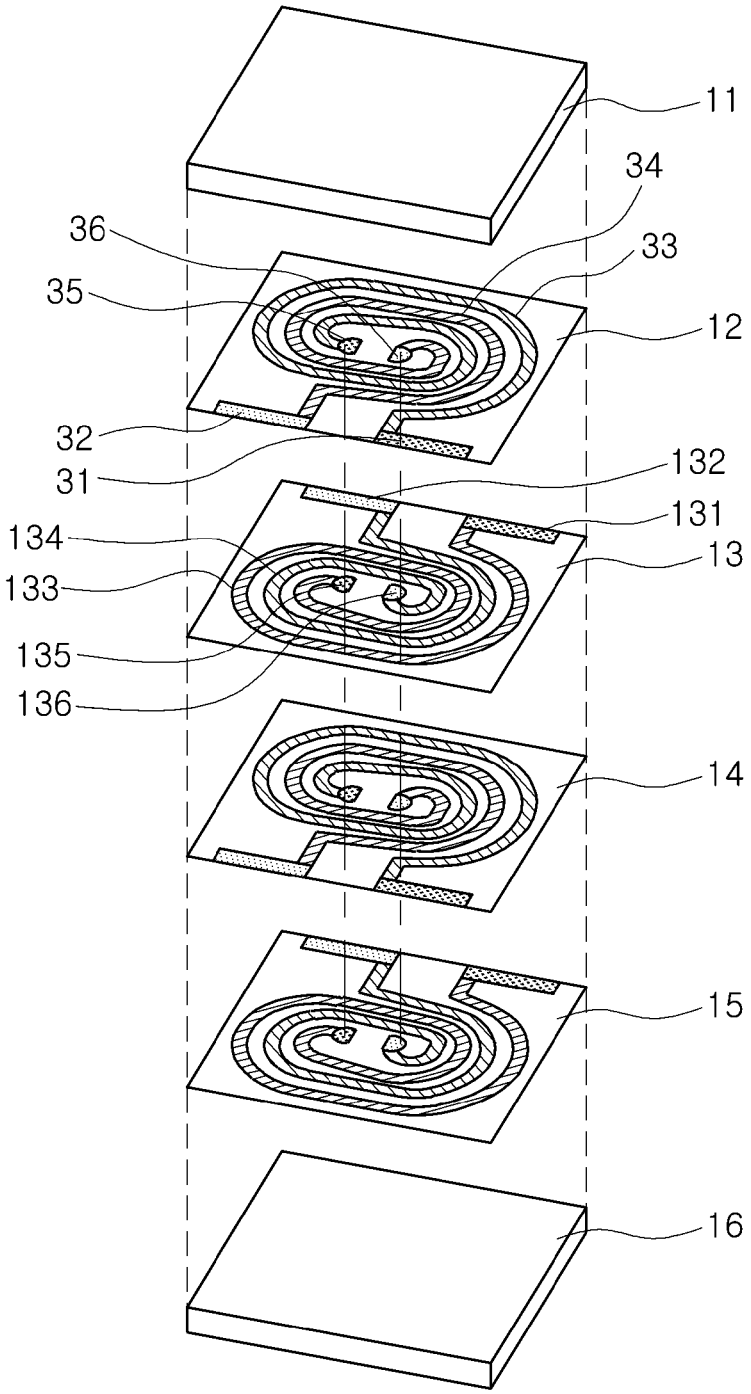
FIG. 2 is an exploded perspective view of the thin film-type coil component of FIG. 1, according to an embodiment of the present invention.
Figure 3:
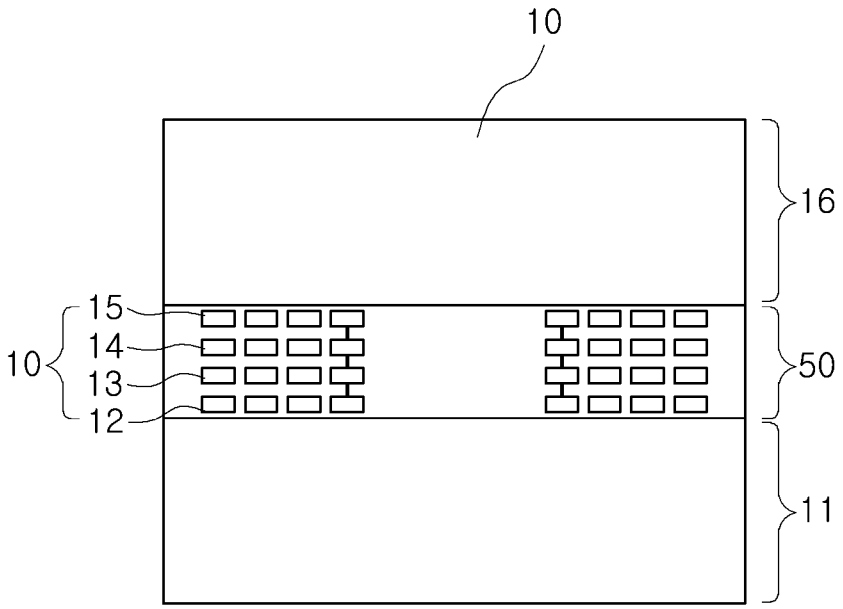
FIG. 3 is a cross-sectional view of the thin film-type coil component taken along a line X-X' of FIG. 1, according to an embodiment of the present invention.
Figure 4:
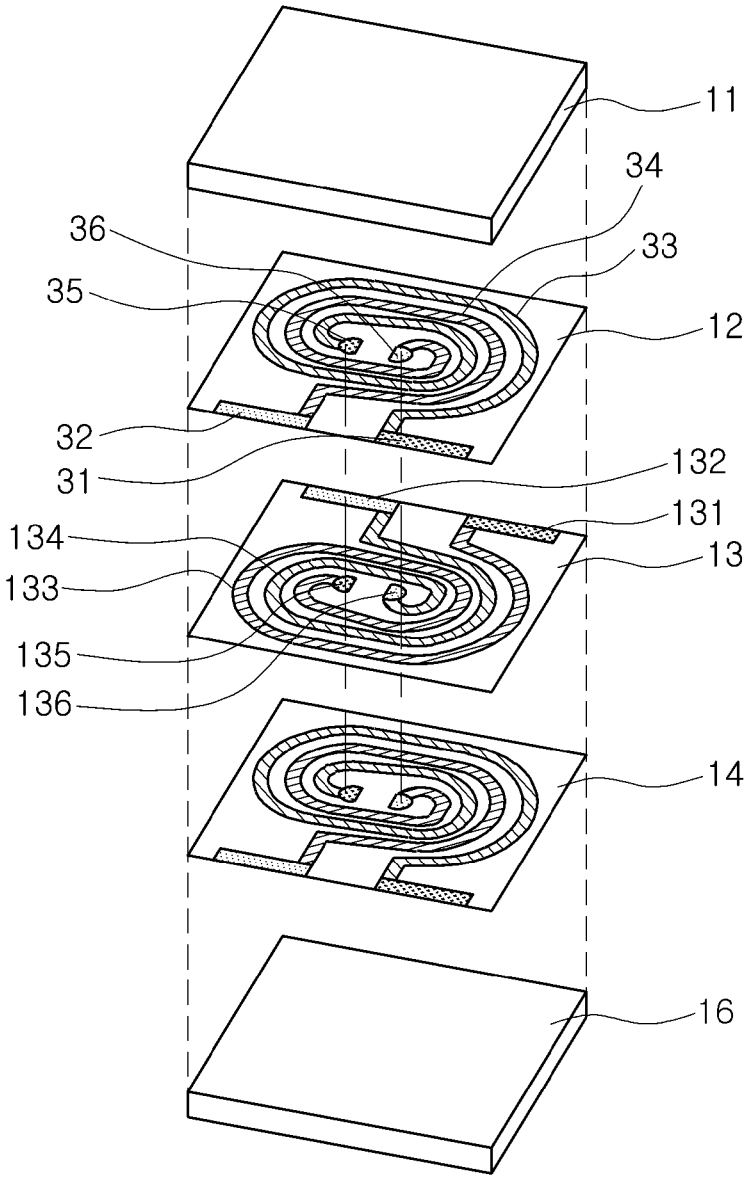
FIGS. 4 and 5 are exploded perspective views of a thin film-type coil component according to other embodiments of the present invention.
Figure 5:
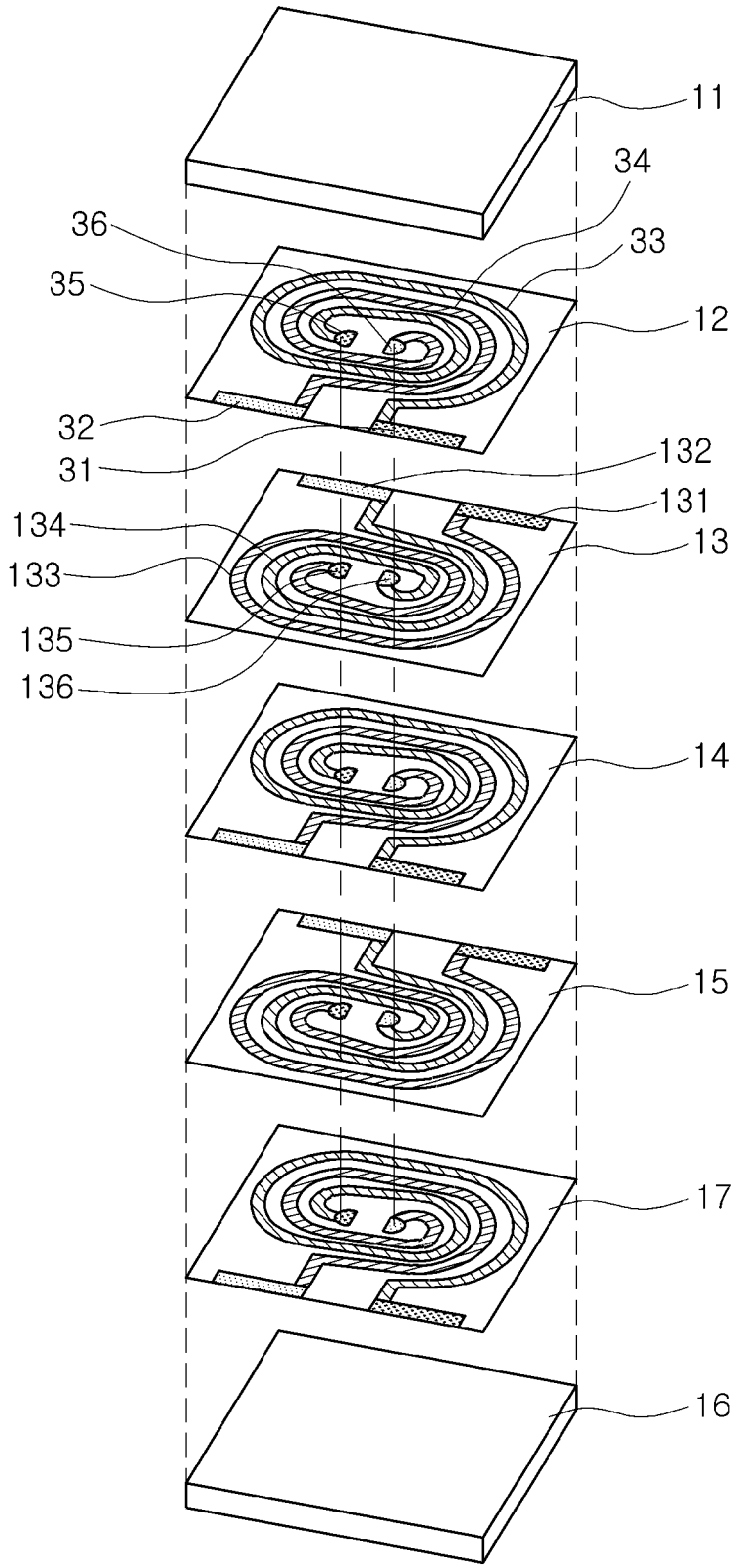
Figure 6:
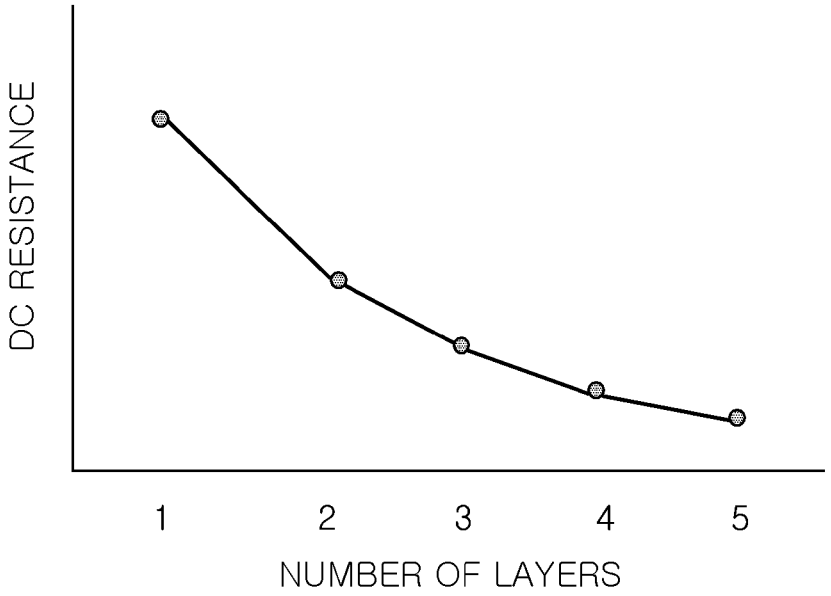
FIG. 6 is a graph showing a relationship between the number of coil layers and direct current (DC) resistance with respect to a thin film-type coil component, according to an embodiment of the present invention.

FIG. 1 is a perspective view of a thin film-type coil component according to an embodiment of the present invention. FIG. 2 is an exploded perspective view of the thin film-type coil component of FIG. 1, according to an embodiment of the present invention. FIG. 3 is a cross-sectional view of the thin film-type coil component taken along a line X-X' of FIG. 1, according to an embodiment of the present invention. FIGS. 4 and 5 are exploded perspective views of thin film-type coil component according to other embodiments of the present invention. FIG. 6 is a graph showing a relationship between the number of coil layers and direct current (DC) resistance with respect to a thin film-type coil component, according to an embodiment of the present invention.

Referring to FIGS. 1 and 2, a thin film-type coil component according to an embodiment of the present invention may include a main body 10 and external electrodes 21 through 24 formed on an outer surface of the main body 10.

Throughout this specification, the terms, "first" and "second" are only used to distinguish one element from another element, rather than being limited to the order.

The main body 10 may have a rectangular parallelepiped shape. "L direction", "W direction", and "T direction" are also be referred to as "longitudinal direction", "width direction", and "thickness direction", respectively.

The main body 10 may include an upper substrate 11, a lower substrate 16, and an insulating layer 50 formed between the upper substrate 11 and the lower substrate 16. First through fourth coil layers 12 through 15 may be formed in the insulating layer 50.

Hereinafter, a single coil layer will be described with reference to FIGS. 1 through 4.

Referring to FIG. 2, the first coil layer 12 may include a double coil. First and second coils 33 and 34 may be wound to be parallel to each other in the same direction on the same plane and may be collectively referred to as the double coil.

When a single coil is used, it is necessary to form two layers. However, when the double coil is used, the double coil may be embodied by using a single layer. In addition, since outlet terminals 31 and 32 are formed on the same layer as that of the double coil, a separate layer may not be required for forming the outlet terminals 31 and 32 thereon. Accordingly, manufacturing processes may be simplified, thereby reducing manufacturing costs.

One ends of the first and second coils 33 and 34 may be connected to the external electrodes 21 and 23, respectively. The other ends of the first and second coils 33 and 34 may be connected to first and second centers 35 and 36, respectively.

The center of the first coil 33 may be the first center 35. The center of the second coil 34 may be the second center 36.

Since the first and second coils 33 and 34 are formed to be in parallel to constitute the double coil, the first and second centers 35 and 36 may be spaced apart from each other without overlapping with each other.

The double coil may include at least one selected from the group consisting of gold (Au), silver (Ag), platinum (Pt), copper (Cu), nickel (Ni), palladium (Pd), and an alloy thereof. The first and second coils 33 and 34 constituting the double coil may be formed of any material as long as the double coil may have conductivity and may not be limited to the above-described metals.

The first and second coils 33 and 34 may be connected to the external electrodes 21 and 23 through the outlet terminals 31 and 32, respectively.

When the first and second coils 33 and 34 are respectively connected directly to the external electrodes 21 and 23, since the first and second coils 33 and 34 have patterns having relatively small width and thickness, the external electrodes 21 through 24 may not be smoothly connected to the first and second coils 33 and 34, due to a relatively small cross-sectional area of connection portions between the external electrodes 21 and 23 and the first and second coils 33 and 34. In addition, even in a case in which the external electrodes 21 and 23 may be connected to the first and second coils 33 and 34, respectively, the external electrodes 21 and 23 may be easily disconnected from the first and second coils 33 and 34 by external shocks and so on.

In order to prevent this defect, the outlet terminals 31 and 32 are formed at the first and second coils 33 and 34, respectively. In addition, the external electrodes 21 and 23 may be connected to the first and second coils 33 and 34 through the outlet terminals 31 and 32, respectively. Due to the existence of the outlet terminals 31 and 32, a cross-sectional area of the connection portions between the external electrodes 21 and 23 and the first and second coils 33 and 34 may be increased.

Portions of the outlet terminals 31 and 32, exposed from a surface of the main body 10, may be covered by the external electrodes 21 and 23, respectively, thereby preventing a plating solution and external impurities from penetrating into the outlet terminals 31 and 32 so as to improve the reliability of the thin film-type coil component.

The outlet terminals 31 and 32 may be formed of the same material as the first and second coils 33 and 34. This is because, when the outlet terminals 31 and 32 and the first and second coils 33 and 34 are formed of different materials, mechanical and electrical connections at interfaces between the outlet terminals 31 and 32 and the first and second coils 33 and 34 may not be completely obtained, thereby increasing DC resistance.

In detail, the outlet terminals 31 and 32 and the first and second coils 33 and 34 may include at least one selected from the group consisting of Au, Ag, Pt, Cu, Ni, Pd, and an alloy thereof. The outlet terminals 31 and 32 may be formed of any material as long as the outlet terminals 31 and 32 may have conductivity and may not be limited to the above-described metals.

Hereinafter, a connection relationship between coil layers will be described.

A plurality of coil layers, that is, the first through fourth coil layers 12 through 15 may be formed in the insulating layer 50. FIG. 2 shows a case the thin film-type coil component includes four coil layers. However, the present invention is not limited to this case.

The first and second coils 33 and 34 and first and second coils 133 and 134 may be connected to each other in parallel, respectively.

That is, a plurality of first coils, that is, the first coils 33 and 133 may be respectively disposed on a plurality of coil layers and may be connected to each other in parallel.

Similarly, a plurality of second coils, that is, the second coils 34 and 134 may be respectively disposed on a plurality of coil layers and may be connected to each other in parallel.

A parallel connection structure may be implemented by connecting a plurality of coils to the same external electrode and electrically connecting first centers and second centers of a plurality of respective layers through via conductors.

For example, the parallel connection structure will be described in detail with regard to the first coils 33 and 133.

One end of the first coil 33 of the first coil layer 12 and one end of a first coil 233 of the third coil layer 14 may be connected to the first external electrode 21. First centers 35, 136, 235 and 336 of the first through fourth coil layers 12 through 15 may be connected to each other through via conductors, respectively. Both one end of the first coil 133 of the second coil layer 13 and one end of the first coil 333 of the fourth coil layer 15 may be connected to a second external electrode 22.

The first coil 33 of the first coil layer 12 and the first coil 233 of the third coil layer 14 may be connected to each other in parallel, between the first external electrode 21 and the first centers 35, 136, 235, and 336. In addition, the first coil 133 of the second coil layer 13 and the first coil 333 of the fourth coil layer 15 may be connected to each other in parallel, between the first centers 35, 136, 235, and 336 and the second external electrode 22.

In other words, two resistors connected to each other in parallel and other two resistors connected to each other in parallel may be connected in series to each other. When a resistance value of a single resistor is R, a total equivalent resistance value is R.

When a plurality of coil layers are stacked, DC resistance may be reduced. In this case, the line width and thickness of a coil may be reduced by as much as the reduced DC resistance, thereby increasing the turn number of the coil and obtaining a thinned coil layer.

First centers and second centers of neighboring coil layers among a plurality of coil layers may be connected through via conductors, respectively.

Neighboring coil layers among a plurality of coil layers may be connected to first and second external electrodes, respectively.

Referring to FIGS. 1 and 2, the first and second coils 33 and 34 of the first coil layer 12 may be connected to the first external electrodes 21 and 23, respectively. The first and second coils 133 and 134 of the second coil layer 13 may be connected to the second external electrodes 22 and 24, respectively.

Coils of neighboring coil layers among a plurality of coil layers may be wound in opposite directions.

Referring to FIGS. 1 and 2, with regard to the first coil layer 12, the first and second coils 33 and 34 may be wound clockwise and outward from the first and second centers 35 and 36, respectively. On the other hand, with regard to the second coil layer 13, the first and second coils 133 and 134 may be wound counterclockwise and outward from the first and second centers 135 and 136, respectively. Accordingly, directions of magnetic fields generated due to current flowing through coils may be consistent with each other.

The upper and lower substrates 11 and 16 may be formed of a magnetic material. The magnetic material may include nickel-zinc-copper (Ni—Zn—Cu) ferrite.

The insulating layer 50 may include a photosensitive polymer insulating material. In addition, a photosensitive insulating material may be interposed between neighboring coil layers and the neighboring coil layers may be connected through a via hole.

First, a first coil layer may be formed on a lower substrate and a photosensitive insulating material may be coated on the first coil layer. A via conductor may be formed to penetrate through the layer formed by coating the photosensitive insulating material. A second coil layer may be formed on the via conductor. The second coil layer may be formed by using a photo lithography method. The first and second coil layers may be connected to each other through the via conductor.

External electrodes may include the first and second external electrodes 21 through 24. A plurality of external electrodes, that is, the first external electrodes 21 and 23 may be formed on one surface S2 of the main body 10. A plurality of external electrodes, that is, the second external electrodes 22 and 24 may be formed on the other surface S5 facing one surface S2 of the main body 10.

The plurality of external electrodes, that is, the first and second external electrodes 21 through 24 may be arranged to face each other.

The first and second external electrodes 21 through 24 may extend in the thickness direction ("T direction") of the main body 10. The first and second external electrodes 21 through 24 may be spaced apart from each other and may be electrically disconnected from each other.

The first and second external electrodes 21 through 24 may extend onto portions of an upper surface S3 and a lower surface S4 of the main body 10.

Connection portions between the first and second external electrodes 21 through 24 and the main body 10 formed of ceramic may each have an 'L' shape so as to increase adhesion between the external electrodes 21 through 24 and the main body 10 formed of ceramic, thereby increasing resistance against external shocks and so on.

The first and second external electrodes 21 through 24 may be formed of any metal as long as the external electrodes 21 through 24 may have electrical conductivity. In detail, the first and second external electrodes 21 through 24 may include at least one selected from the group consisting of Au, Ag, Pt, Cu, Ni, Pd, and an alloy thereof. Although Au, Ag, Pt, and Pd are expensive, they are stable. Although Cu and Ni are inexpensive, since they are oxidized while being sintered, the electrical conductivity of them may be reduced.

A via conductor (not shown) and the first and second coils 33 and 34 may be formed of the same material.

When the via conductor and the first and second coils 33 and 34 are formed of the same material, the via conductor and coil patterns, that is, the first and second coils 33 and 34, may be stably connected to each other, thereby obtaining the stable electrical properties of an electronic component. However, when the via conductor and the coil patterns, that is, the first and second coils 33 and 34, are formed of different materials, DC resistance may be increased due to an interfaces therebetween.

The thin film-type coil component according to embodiments of the present invention may have a size equal to or less than 0806, for example, 0605.

When a chip has a large size, since the line width and thickness of a coil may be increased, defects in terms of deteriorated properties of a product due to the increased DC resistance may not arise. However, along with the development of the small-sized products, as a chip size is reduced, it may be difficult to increase the line width and thickness of the coil due to the limited chip size. Thus, defects in terms of deteriorated properties of a product due to the increased DC resistance may arise. According to embodiments of the present invention, defects that arise as a chip size is reduced may be prevented.

In detail, a size 1210 may refer to (1.25±0.1 mm)×(1.0±0.1 mm)×(0.82±0.1 mm), a size 0806 may refer to (0.85±0.05 mm)×(0.65±0.05 mm)×(0.4±0.05 mm), and a size 0605 may refer to (0.65±0.05 mm)×(0.55±0.05 mm)×(0.3±0.05 mm).

Table. 1 shows DC resistance values that are measured with respect to three chip sizes, that is, the sizes 1210, 0806, and 0605.

TABLE 1

| Division | Chip Size | Number of Coil layers | DC Resistance (Ω) |
|---|---|---|---|
| Sample 1 | 1210 | 2 | 1.5 |
| Sample 2 | 0806 | 2 | 2.7 |
| Sample 3 | 0605 | 4 | 3.0 |

As shown in Table 1, Sample 1 corresponds to a case where a chip size is 1210 and the number of coil layers is 2. In this case, since DC resistance is 1.5Ω that is sufficiently low, the defects with increased DC resistance may not arise.

Sample 2 corresponds to a case where a chip size is 0806 and the number of coil layers is 2. DC resistance is 2.7Ω that is increased about two times higher than in Sample 1. In this case, it is confirmed that, since there is a limit in increasing the line with and thickness of a coil as the chip size is reduced, DC resistance is rapidly increased.

Sample 3 corresponds to a case where a chip size is 0605 and the number of coil layers is 4. DC resistance is 3.0Ω. In particular, when a chip size is 0605 and the number of coil layers is equal to or less than 3, the performance of a product may not be obtained.

That is, according to the embodiments of the present invention, the defects due to increased DC resistance along with the development of the small-sized chip, arising in a product having a size equal to or less than 0806, may be prevented.

The double coil, that is, the first and second coils 33 and 34 may have a polygonal shape such as a tetragonal shape, a pentagonal shape, and a hexagonal shape, a circular shape, an oval shape, or an irregular shape.

The double coil, that is, the first and second coils 33 and 34 may each have any spiral shape as long as a magnetic field may be induced when current flows through the double coil and may not be limited to the above-described shapes.

When the main body 10 has a rectangular parallelepiped shape, the double coil, that is, the first and second coils 33 and 34 may have a tetragonal shape, and thus, since the area of an inner portion of the double coil is significantly increased, the intensity of induced magnetic field may be significantly increased.

Accordingly, the double coil may have various shapes according to the shape of the main body 10 and may have a shape obtained by combining two or more shapes among the above-described shapes.

FIG. 2 shows a case where the thin film-type coil component includes four coil layers, that is, the first through fourth coil layers 12 through 15. However, alternatively, as shown in FIGS. 4 and 5, the thin film-type coil component may include three coil layers 12 through 14 or five coil layers 12 through 15 and 17.

Hereinafter, equivalent resistance in cases where three, four, and five coil layers are used as shown in FIGS. 4, 2, and 5 will be described.

FIG. 4 shows a case where two resistors connected to each other in parallel and a single resistor are connected in series to each other. When resistance of a single resistor is R, total equivalent resistance is (3/2)R.

FIG. 2 shows a case where two resistors connected to each other in parallel and other two resistors connected to each other in parallel are connected in series to each other. When resistance of a single resistor is R, total equivalent resistance is R.

FIG. 5 shows a case where three resistors connected to each other in parallel and other two resistors connected to each other in parallel are connected in series to each other. When resistance of a single resistor is R, total equivalent resistance is (5/6)R.

Comparing FIGS. 2, 4, and 5, as the number of coil layers is increased to 3, 4, and 5, equivalent resistance may be gradually reduced to (3/2)R→R→(5/6)R. The number of coil layers may be appropriately determined according to property requirements of a product.

Referring to FIG. 6, it may be confirmed that, as the number of coil layers is increased, DC resistance is gradually reduced.

Hereinafter, a method of fabricating a thin film-type coil component according to another embodiment of the present invention will be described.

A method of fabricating a thin film-type coil component according to another embodiment of the present embodiment may include a first operation of forming a first double coil having first and second centers on a lower substrate; a second operation of forming an insulating layer on the lower substrate on which the first double coil has been formed; a third operation of forming via conductors in portions of the insulating layer, corresponding to the first and second centers of the first double coil; a fourth operation of forming a second double coil on the insulating layer so as to have centers that are respectively formed to correspond to the via conductors; a fifth operation of forming a stack structure including a required number of layers formed by repeating the second through fourth operations; and a sixth operation of forming an upper substrate on the stack structure.

In the first and fourth operations, the first and second double coils may be formed by a photo lithography method. When the photo lithography method is used, the line width and thickness of a coil may be precisely adjusted.

In the second operation, the insulating layer may be formed by using a method in which an insulating material is coated on a substrate on which the first double coil has been formed. In detail, the insulating material may be coated by using a spin coating method.

In the third operation, the via conductors may be formed by using a photo lithography method.

The first and second coils may be wound in opposite directions.

The first and second centers may be spaced apart from each other.

The double coil may have a polygonal shape, a circular shape, an oval shape, or an irregular shape.

The double coil may include at least one selected from the group consisting of Au, Ag, Pt, Cu, Ni, Pd, and an alloy thereof.

The upper and lower substrates may be formed of a magnetic material.

The magnetic material may include Ni—Zn—Cu ferrite.

The insulating layer may include a photosensitive polymer insulating material.

The upper substrate, the lower substrate, the insulating layer, and the coil are the same as those described above with respect to FIGS. 1 through 6.

Hereinafter, reference will now be provided in detail to the present invention with reference to experimental examples.

A thin film-type coil component according to an embodiment of the present invention was prepared as follows First, polyvinyl butyral as a binder and ethanol as an organic solvent were mixed with Ni—Zn—Cu ferrite powders and then a ball mill method was performed on the mixture to prepare a magnetic slurry.

A magnetic green sheet was prepared by a doctor blade method using the magnetic slurry.

The magnetic green sheet was sintered at a temperature of 1000⌊ to prepare an upper substrate and a lower substrate.

A double coil was formed on the lower substrate. A photosensitive polymer insulating material was coated on the lower substrate on which the double coil has been formed, by using a spin coating method. Via conductors were formed to correspond to centers of the double coil. Another double coil was formed on the via conductors. In this case, a photo lithography method was used.

A required number of coil layers were formed by repeating the above-described processes. According to the present embodiment, the above-described processes were repeated until five coil layers were formed.

Chips having a size 0806 and a size 0605 were fabricated by using the above-described processes. In the chip having a size 0806, the number of coil layers was changed from 2 to 5. In the chip having a size 0605, the number of coil layers was changed from 3 to 5.

A measurement result of DC resistance of the chip having a size 0806 is shown in Table 2 below. A measurement result of DC resistance of the chip having a size 0605 is shown in Table 3 below. DC resistance was measured by using a 4-point probe method.

TABLE 2

| Division | Number of coil layers | DC Resistance (Ω) |
|---|---|---|
| Sample 4 | 2 | 2.7 |
| Sample 5 | 3 | 2.0 |
| Sample 6 | 4 | 1.35 |
| Sample 7 | 5 | 1.13 |

As shown in Table 2, it may be confirmed that, in the chip having a size 0806, as the number of coil layers is increased, DC resistance is reduced.

TABLE 3

| Division | Number of coil layers | DC Resistance (Ω) of Coil according to the related art | DC Resistance (Ω) |
|---|---|---|---|
| Sample 8 | 3 | — | 2.25 |
| Sample 9 | 4 | 3.0 | 1.5 |
| Sample 10 | 5 | — | 1.25 |

As shown in Table 3, it may be confirmed that, as the number of coil layers is increased, DC resistance is reduced.

In particular, Sample 9 corresponds to a case where the number of coil layers is 4. In this case, when four layers are implemented by using coil according to the related art, DC resistance is 3.0Ω. However, it may be confirmed that, when a double coil according to the embodiment of the present invention is used, DC resistance is 1.5Ω that is halved. In this case, the coil according to the related art refers to a case in which a single coil is used instead of using a double coil.

As set forth above, according to the embodiments of the present invention, there are provided a thin film-type coil component having relatively low DC resistance and a method of fabricating the thin film-type coil component.

While the present invention has been shown and described in connection with the embodiments, it will be apparent to those skilled in the art that modifications and variations can be made without departing from the spirit and scope of the invention as defined by the appended claims.

What is claimed is:

1. A thin film-type coil component, comprising:

a main body; and external electrodes including a plurality of first external electrodes formed on one surface of the main body and a plurality of second external electrodes formed on the other surface facing one surface of the main body, the main body including:

an upper substrate and a lower substrate;

an insulating layer formed between the upper substrate and the lower substrate; and a coil layer disposed in the insulating layer and including first and second coils as a double coil, wherein:

the first and second coils are wound to be parallel to each other in the same direction on the same plane, the first and second coils are respectively started in different directions from first and second centers, one ends of the first and second coils are connected to the external electrodes, the other ends of the first and second coils are respectively connected to first and second centers, and first and second centers are respectively connected through via conductors, the main body includes more than three coil layers, and the first and second coils are connected to each other in parallel, the thin film-type coil component has a size equal to or less than 0806 {(0.85±0.05 mm)×(0.65±0.05 mm)×(0.4±0.05 mm)}, and the insulating layer includes a photosensitive polymer insulating material.

2. The thin film-type coil component of claim 1, wherein the neighboring coil layers among the plurality of coil layers are connected to first and second external electrodes, respectively.

3. The thin film-type coil component of claim 1, wherein coils of the neighboring coil layers among the plurality of coil layers are wound in opposite directions.

4. The thin film-type coil component of claim 1, wherein the first and second centers are spaced apart from each other.

5. The thin film-type coil component of claim 1, wherein the double coil has a polygonal shape, a circular shape, an oval shape, or an irregular shape.

6. The thin film-type coil component of claim 1, wherein the double coil includes at least one selected from the group consisting of gold (Au), silver (Ag), platinum (Pt), copper (Cu), nickel (Ni), palladium (Pd), and an alloy thereof.

7. The thin film-type coil component of claim 1, wherein the first coil and the second coil are connected to the external electrodes through outlet terminals, respectively.

8. The thin film-type coil component of claim 7, wherein portions of the outlet terminals exposed from a surface of the main body are covered by the external electrodes.

9. The thin film-type coil component of claim 7, wherein the outlet terminals include at least one selected from the group consisting of Au, Ag, Pt, Cu, Ni, Pd, and an alloy thereof.

10. The thin film-type coil component of claim 7, wherein the double coil and the outlet terminals include the same material.

11. The thin film-type coil component of claim 1, wherein the upper substrate and the lower substrate are formed of a magnetic material.

12. The thin film-type coil component of claim 1, wherein the magnetic material includes nickel-zinc-copper (Ni—Zn—Cu) ferrite.

13. The thin film-type coil component of claim 1, wherein the plurality of first and second external electrodes are arranged to face each other.

14. The thin film-type coil component of claim 1, wherein the external electrodes extend in a thickness direction of the main body.

15. The thin film-type coil component of claim 1, wherein the external electrodes extend onto portions of an upper surface and a lower surface of the main body.

16. The thin film-type coil component of claim 1, wherein the external electrodes include at least one selected from the group consisting of Au, Ag, Pt, Cu, Ni, Pd, and an alloy thereof.

* * * * *